US010638912B1

(12) United States Patent
Visin et al.

(10) Patent No.: US 10,638,912 B1
(45) Date of Patent: May 5, 2020

(54) DISHWASHER AND ADJUSTABLE TINE ROW

(71) Applicant: WHIRLPOOL CORPORATION, Benton Harbor, MI (US)

(72) Inventors: Jerry M. Visin, Benton Harbor, MI (US); John A. Hall, Holland, MI (US); Darryl C. Bodine, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 3 days.

(21) Appl. No.: 16/268,828

(22) Filed: Feb. 6, 2019

(51) Int. Cl.
*A47L 15/50* (2006.01)

(52) U.S. Cl.
CPC ..... *A47L 15/50* (2013.01); *A47L 15/503* (2013.01); *A47L 15/507* (2013.01)

(58) Field of Classification Search
CPC ..... A47L 15/20; A47L 15/503; A47L 15/507; A47L 15/50
See application file for complete search history.

(56) References Cited

U.S. PATENT DOCUMENTS 2,624,535 A * 1/1953 Bollhoefer ..... B41J 29/06 108/116
3,614,187 A * 10/1971 Cuthbert ..... A47L 15/507 312/351
3,761,153 A 9/1973 Guth
5,601,195 A 2/1997 Finola et al.
5,860,716 A * 1/1999 Good ..... A47L 15/504 312/311
7,168,578 B2 * 1/2007 Mersch ..... A47L 15/504 134/56 D
7,231,929 B2 6/2007 Landsiedel et al.
7,418,967 B2 * 9/2008 Kim ..... A47L 15/504 134/201
8,079,287 B2 12/2011 Castillo
8,157,339 B2 * 4/2012 Park ..... A47B 88/483 312/404
8,646,620 B2 2/2014 Klump et al.
9,629,515 B2 4/2017 Chan et al.
2012/0261541 A1 * 10/2012 Lai ..... F16M 11/10 248/346.5

FOREIGN PATENT DOCUMENTS

EP 2225996 A1 9/2010
KR 101210124 B1 12/2012

* cited by examiner

*Primary Examiner* — Ko H Chan
(74) *Attorney, Agent, or Firm* — McGarry Bair PC

(57) ABSTRACT

A dishwasher having a tub at least partially defining a treating chamber at least one dish rack having a floor and a perimeter wall extending from the floor and defining an interior, at least one set of tines having at least a portion of the at least one set of tines extend into the interior of the dish rack, the at least one set of tines configured to rotate and having a protrusion extending along an axis of rotation of the at least one set of tines and a tine angle adjustment assembly.

27 Claims, 10 Drawing Sheets

DISHWASHER AND ADJUSTABLE TINE ROW

BACKGROUND

Contemporary automatic dishwashers for use in a typical household include a tub that can have an open front and at least partially defines a treating chamber into which items, such as kitchenware, glassware, and the like, can be placed to undergo a washing operation. At least one rack or basket for supporting soiled dishes can be provided within the tub. A spraying system with multiple sprayers can be provided for recirculating liquid throughout the tub to remove soils from the dishes. The dishwasher can be provided with a door, which can be pivotally mounted to the tub that closes the open front. The at least one rack or basket can be provided in the form of upper and lower dish racks.

BRIEF DESCRIPTION

The disclosure relates to a dish rack assembly, including at least one dish rack defining an interior, at least one set of tines having at least a portion of the at least one set of tines extend into the interior of the dish rack, the at least one set of tines configured to rotate and having a protrusion extending along an axis of rotation of the at least one set of tines, and a tine angle adjustment assembly including a clip having a body configured to mount on at least a portion of the at least one dish rack, the clip having a set of notches radially spaced about at least a portion of the body and a rotatable knob having at least one detent, the rotatable knob operably coupled to the set of tines and wherein a position of the knob selectively rotationally locates the at least one detent with respect to the set of notches to determine a rotational position of the set of tines.

DETAILED DESCRIPTION

In order to provide more flexibility to users, tines or rows of tines can be included with at least one of the dish racks to provide support for various items loaded into the dishwasher. The angle of the tines relative to the dish rack can be adjustable to allow a user the flexibility to select the desired tine angle to accommodate the particular items to be washed during a particular cycle of the dishwasher. Typically, such tine angle adjustment methods include the user bending the tine and repositioning the tine in a different location. Such methods increase the likelihood that a tine could be bent or stressed, as well as calling for an undesirable amount of force to be exerted by the user. If sufficient force is not applied, the tine can remain loose and not be firmly held in position, resulting in a lack of support for the dish items to be washed.

Aspects of the present disclosure relate to a tine assembly having a set of adjustable tines, including a tine row, for use with a dish rack of the dishwasher. The set of adjustable tines is adjustable such that set of tines can be maneuverable to a number of positions utilizing a ting angle adjustment assembly. The tine assembly can be suitable for any manner of applications including that of the household dishwasher of FIG. 1, which is illustrated by way of example and not limitation.

Figure 1:
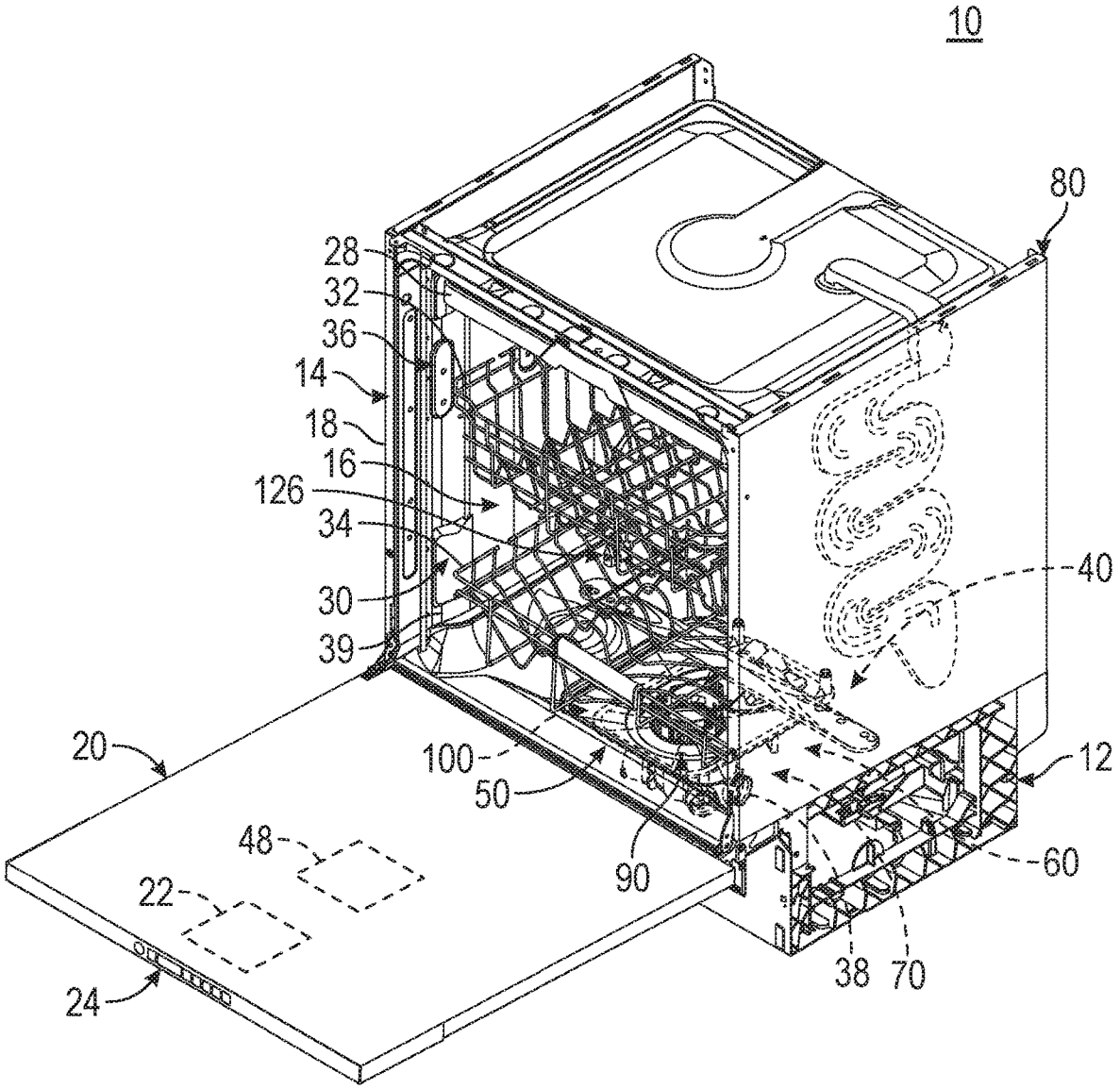
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks," which are located within the treating chamber 16. The upper dish racks 32 and the lower dish rack 34 are typically mounted for slidable movement in to and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold dishes in the form of utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and have the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, rinse agent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
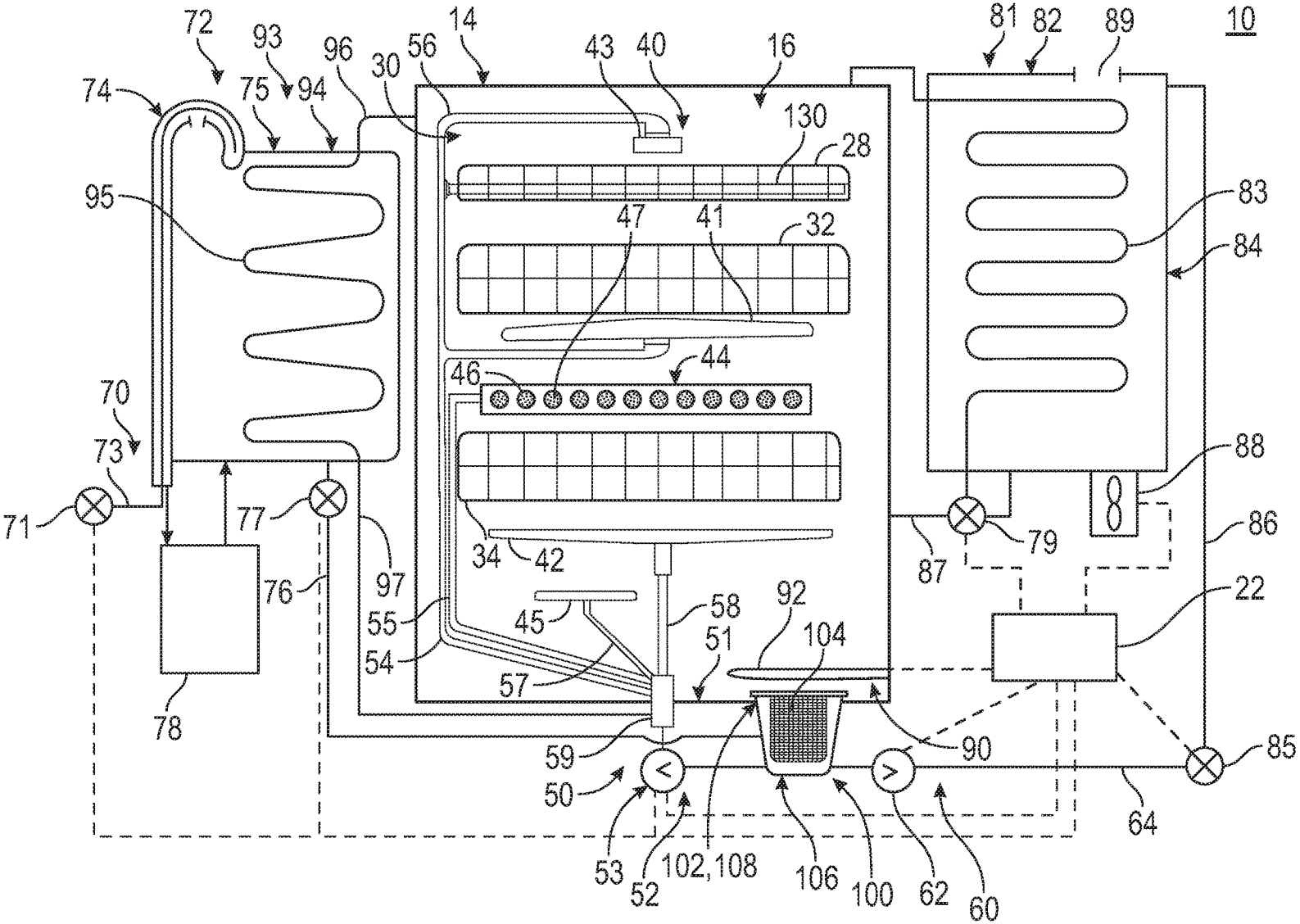
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to a particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28 about a longitudinal axis. The third level sprayer 43 is illustrated as being fixed, but could move, such as in rotating. In addition to the third level sprayer 43 or in place of the third level sprayer 43, the sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which in the illustrated example can be defined along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders where deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and includes the pump assembly 52.

Multiple supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
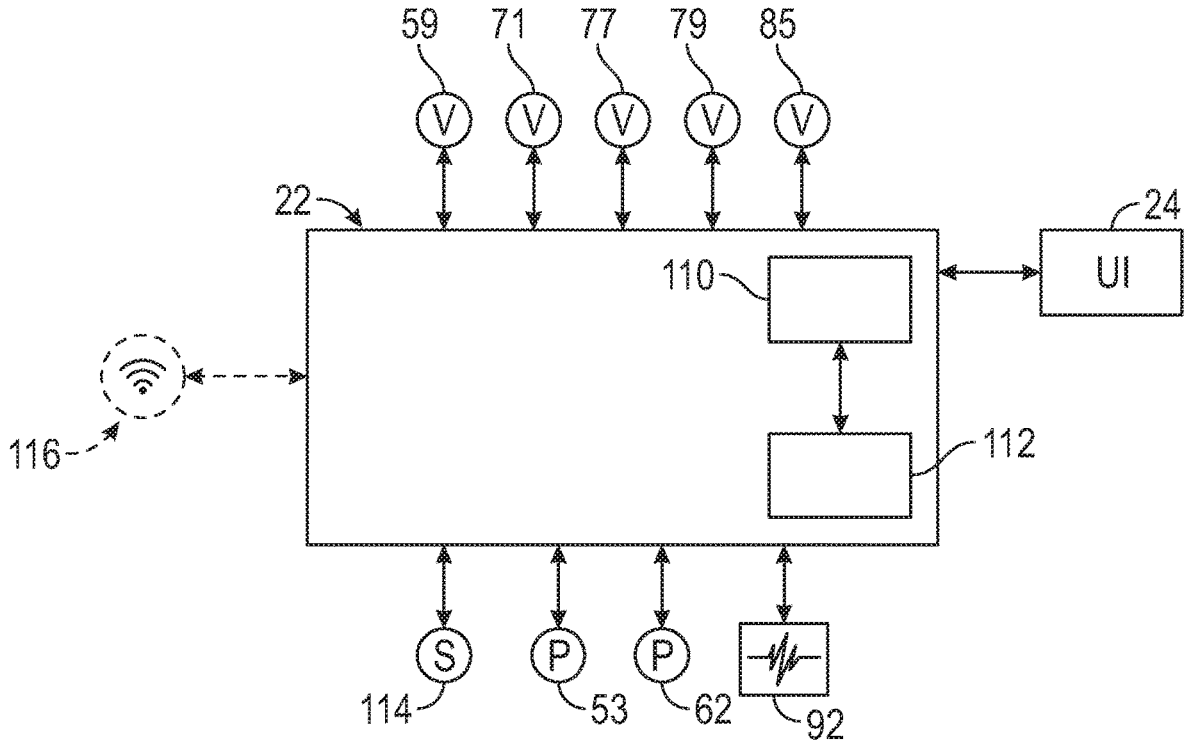
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
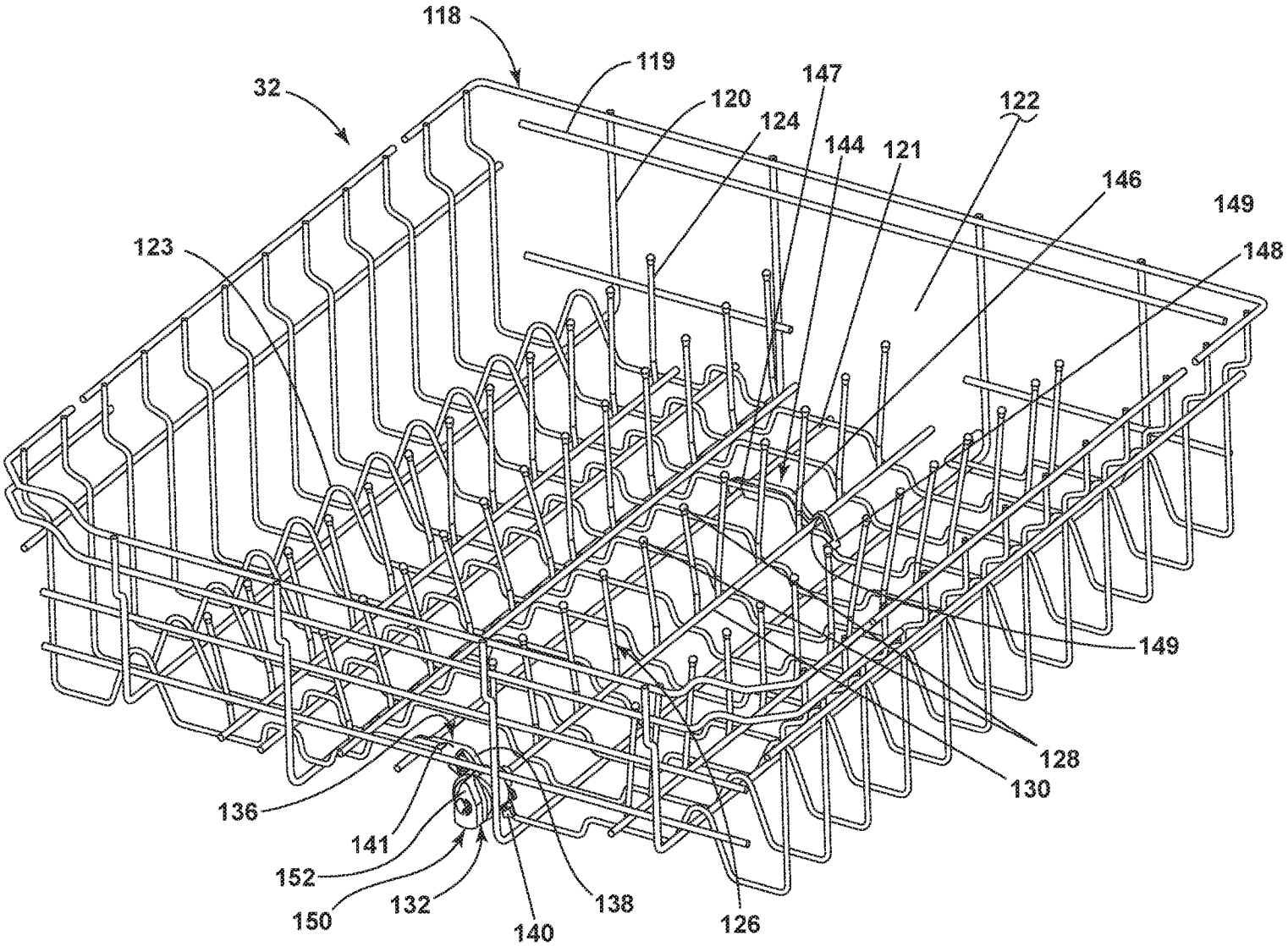
FIG. 4 illustrates a perspective view of the upper dish rack with the adjustable tine row and angle adjustment assembly of FIG. 3 according to an aspect of the present disclosure.

Turning now to FIG. 4, a perspective view of the upper dish rack 32 is illustrated. It will be understood that the upper dish rack 32 and lower dish rack 34 can be formed in any suitable manner. In the illustrated example, a perimeter wall 118, comprising a plurality of cross members 119 and vertical members 120, extending upwardly from a bottom wall, shown as a floor latticework 121, to define an interior 122. Contoured portions 123 of the floor latticework 121 can extend upwardly or downwardly to aid in positioning the various shapes and sizes of dishes within the upper dish rack 32. Further still a plurality of positioning tines 124 can extend upwardly from the floor latticework 121 into the interior 122 to aid in positioning.

Further illustrated is a tine assembly 126. While only the upper dish rack 32 is illustrated as including a tine assembly 126 either or both the upper dish rack 32 or the lower dish rack 34 can include at least one tine assembly 126. It will be understood that the dishwasher 10 can also include a combination of fixed and moveable tines or that all of the tines within the dishwasher 10 can be pilotable tine assemblies 126. At least one tine assembly 126 can be provided within the upper dish rack 32 or the lower rack 26, or both.

At least one set of tines 128 and a cross member 130 are illustrated as forming the tine assembly 126 although it will be understood that the tine assembly 126 can be formed in any suitable shape or manner. For instance, the set of tines 128 are provided as a row or a set of generally vertically oriented, laterally-spaced tines coupled to one another, such as by an elongated element or the cross member 130. It is contemplated that the set of tines 128 can comprise a planar array of parallel positioning tines or that the tines can extend in various angles to form alternative angled supports for supporting dishes in various cleaning positions. The tine assembly 126 can extend fully across a dimension of the upper dish rack 32, as illustrated in FIG. 4. By way of non-limiting example, set of tines 128 can extend along one of a length or a width of the upper dish rack 32. Alternatively, the tine assembly 126 can extend only partially across a dimension of the upper dish rack 32, such as being split into a front portion and a back portion tine assembly 126.

The tine assembly 126 can be rotatably coupled to the upper dish rack 32. That is, where the rotatable tine assembly 126 is provided, the tine assembly 126 can be coupled to the upper dish rack 32 in such a way that the entire tine assembly 126 is rotatably or pivotally mounted to the upper dish rack 32. Alternately, the tine assembly 126 can be fixedly coupled to or integrally formed with the upper dish rack 32 such that only the set of tines 126 themselves are rotatable or pivotable relative to the upper dish rack 32. In the illustrated example, the cross member forms the axis of rotation for the tine assembly 126.

A tine angle adjustment assembly 132 can be coupled an extension 134 (FIG. 7) of the cross member 130 of the tine assembly 126 to provide control of the rotational position of the tine assembly 126 relative to the upper dish rack 32. While the tine angle adjustment assembly 132 is illustrated herein as being coupled with a front of the upper dish rack 32, it will be understood that other locations for the tine angle adjustment assembly 132 are also contemplated. For example, the tine angle adjustment assembly 132 can be coupled with a side or rear of the upper dish rack 32. In the case that the tine assembly 126 does not extend all the way from the front to the rear, but rather covers, for example, a front half or a rear half of the upper dish rack 32, the tine angle adjustment assembly 132 can all be provided in the interior 122 or at a front and rear to control the respective halves or separate portions of the tine assembly 126. In addition, the tine assembly 126 can extend from side-to-side between side walls of the upper dish rack 32, rather than between the front and the rear. In this case, the tine angle adjustment assembly 132 can be provided on the side. It is also contemplated that more than one tine angle adjustment assembly 132 can be provided to couple with a single tine assembly 126, such that one tine angle adjustment assembly 132 couples with each end of the tine assembly 126.

A clip 136 forms a portion of the tine angle adjustment assembly 132 and operably couples the tine angle adjustment assembly 132 to the upper dish rack 32 at a first distal end of the cross member 130. The clip 136 is attached to the upper dish rack 32 by aligning the clip 136 with at least one of the latticework of the perimeter wall 118 or the floor lattice work 121 so that the clip 136 can engage the upper dish rack 132. In the illustrated example, a body 138 of the clip 136 includes a first wire hook 140, second wire hook 141, and third wire hook 142 that engage portions of the floor latticework 121 through a friction fit or snap-fit mechanism to secure the clip 136 to the upper dish rack 32. In the illustrated example, by way of non-limiting example only, the clip 136 is attached to the upper dish rack 32 by hooking the first wire hook and second wire hook on separate portions of a forward most wire in the floor latticework 121 and supporting the third wire hook 142, which is formed as a bight, on the floor latticework 40.

A fastener 144 can also be utilized to aid in locating the tine assembly 126 within the interior 122 of the upper dish rack 32. By way of non-limiting example, the fastener 144 can be located at a second distal end or centralized portion of the cross member 130. The fastener 144 is illustrated as including a body 146 with a first hook 147 at a first distal end and a second hook 148 at a second distal end. The first hook 147 and the second hook 148 are configured to engage portions of the floor lattice work 121. By way of non-limiting example, the first hook 147 and the second hook 148 can engage portions of the floor latticework 121 through a friction fit or snap-fit mechanism to secure the fastener 144 to the upper dish rack 32. While the first hook 147 is illustrated as engaging with a same wire of the floor latticework 121 as the clip 136 it will be understood that this need not be the case. The fastener 144 is also generally shown as following the contours of the floor latticework 121 to remain unobtrusive within the interior 122 although this also need not be the case. A bight 149 is also provided in the body 146 and retains a portion of the cross member 130 of the tine assembly 126. The bight 149 allows for rotation of the cross member 130 but otherwise aids in securing the tine assembly 126 within the interior 122. In this manner, the fastener 144 is configured to rotationally retain, via the bight 149, the cross member 130.

It will be understood that the wires of the upper dish rack, or the lower dish rack 30 as the case may be, are generally flexible enough that the lattice work or wires can be pushed or pulled when installing the clip(s) 136 or fastener(s) 144 of one or more tine assemblies 126. It is also contemplated that the clip 136 or fastener 144 can be easily disengaged from the portions of the upper dish rack 32 to which they are mounted, thereby freeing up the upper dish rack 32 should the user wish to remove the tine assembly 126. The tine assembly 126 merely sits within the interior 122 and is held in place with the clip 136 and fastener 144, so once the clip 136 and fastener 144 are unengaged from the upper dish rack 32 the tine assembly 126 can be removed.

Figure 5:
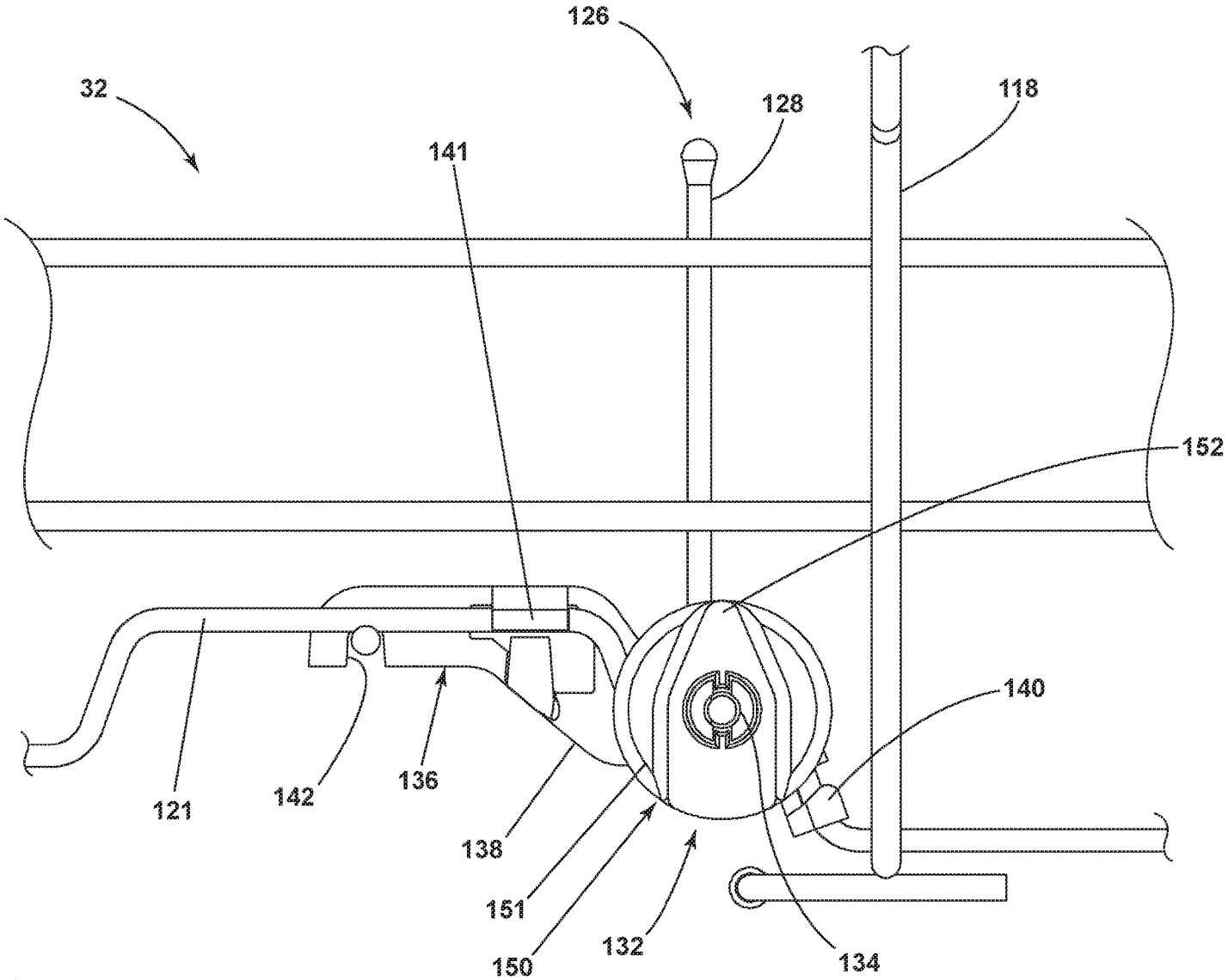
FIG. 5 illustrates a front view of a portion of the upper dish rack with the adjustable tine row and angle adjustment assembly of FIG. 4 in a first position.
Figure 6:
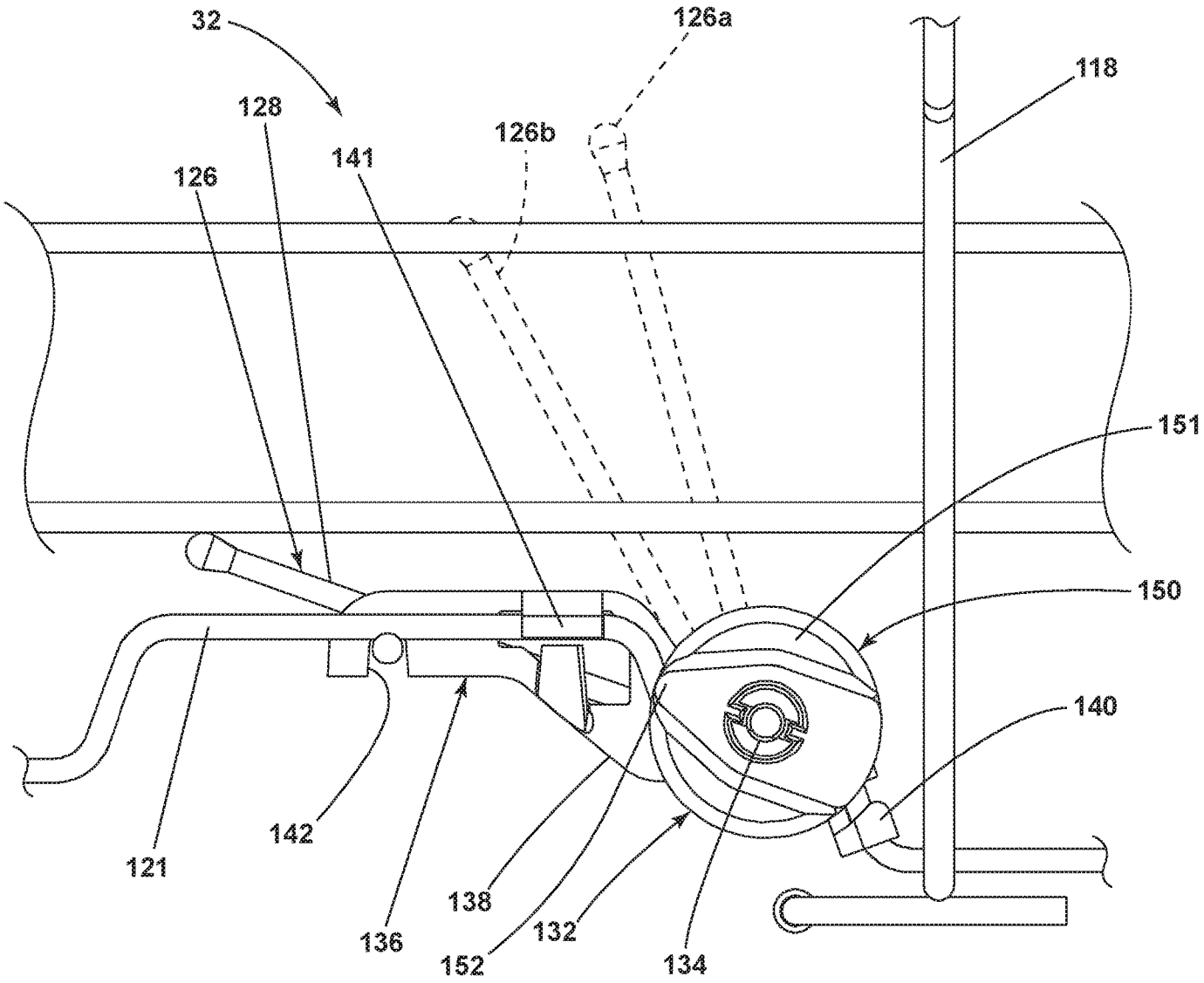
FIG. 6 illustrates a front view of the upper dish rack with the adjustable tine row and angle adjustment assembly of FIG. 4 in a second position.

FIG. 5 illustrates a front view of the tine assembly 126 including the set of tines 128 and tine angle adjustment assembly 132 in a first position. In the second position, the set of tines 128 occupies a raised position relative to the upper dish rack 32 and relative to the second position (FIG. 6). While the first position can be any suitable position in the illustrated example, the first position corresponds to the set of tines 128 being positioned at an angle that is at a vertical orientation. A knob 150 is included in the tine angle adjustment assembly 132 and includes a face 151 having a relief feature in the form of a pointer 152. When the tine angle assembly 126 is located in the vertical position or first position as illustrated, the pointer 152 also points in the vertical direction. The pointer 152 and the set of tines 128 have a coordinating movement such that the pointer 152 and set of tine 128 share a common directionality. In this manner, a user can guide the knob 150 until the pointer 152 is directed a specific angle that the user intends the set of tines 128 to be set at or the pointer can provide an indication of the angle of the set of tines 128.

FIG. 6 illustrates a front view of the tine assembly 126 including the set of tines 128 and tine angle adjustment assembly 132 in a second position. In the second position, the set of tines 128 occupies a lowermost position relative to the upper dish rack 32. In the second position, as illustrated, the set of tines 128 is stopped by the floor latticework 121 of the upper dish rack 32 although it will be understood that this need not be the case. Additionally or alternatively, the tine angle adjustment assembly 132 can include a limiter configured to stop rotational movement of the set of tines 128 at the second position or an alternative other lowermost position. It will be understood that the tine angle assembly 132 can be utilized to move the set of tines 128 to a set of predetermined position between the first position and the second position. By way of non-limiting example, two intermediate use positions are illustrated in phantom as a 30 degree angle, indicated with numeral **126*a* and a 15 degree angle, indicated with numeral 126*b*. Any of the vertical position (FIG. 5), the 30 degree angle illustrated at 126*a* and 15 degree angle illustrated at 126*b* can be considered to be cleaning positions of the tine assembly 126 or use positions, whereas the second position (FIG. 6) can be generally regarded as a stowed position or non-use position of the tine assembly 126**.

Figure 7:
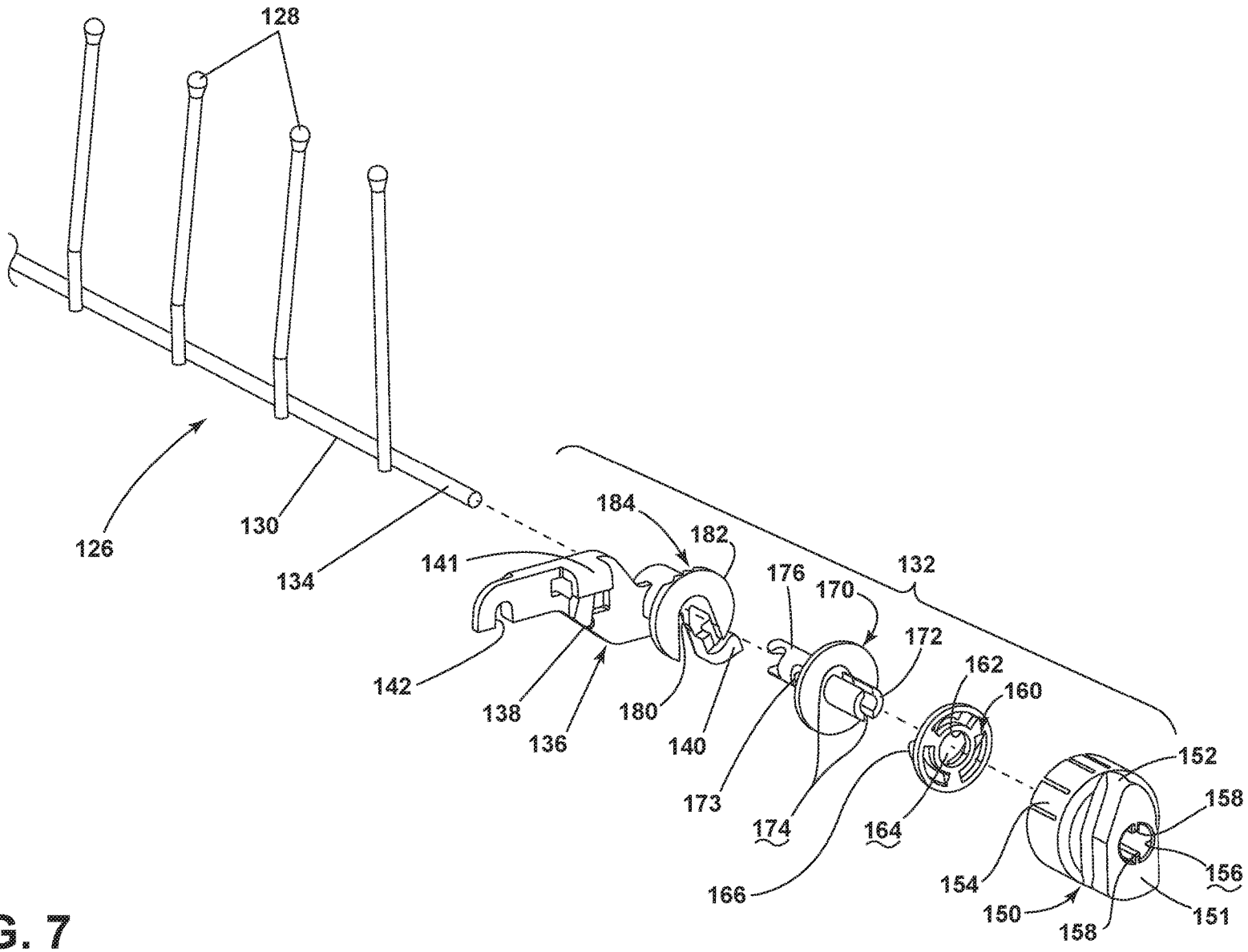
FIG. 7 illustrates a front perspective exploded view of a portion of the adjustable tine row and angle adjustment assembly of FIG. 4.

FIG. 7 illustrates a front exploded perspective view of the tine angle adjustment assembly 132 and portions of the set of tines 128. As better illustrated, the extension 134 of the cross member 130 extends from the first distal end and defines a protrusions, which extends laterally beyond a distal one of the spaced set of tines 128 at the first distal end. The cross-member 130 and extension 134 define the axis of rotation of the set of tines 128.

Figure 8:
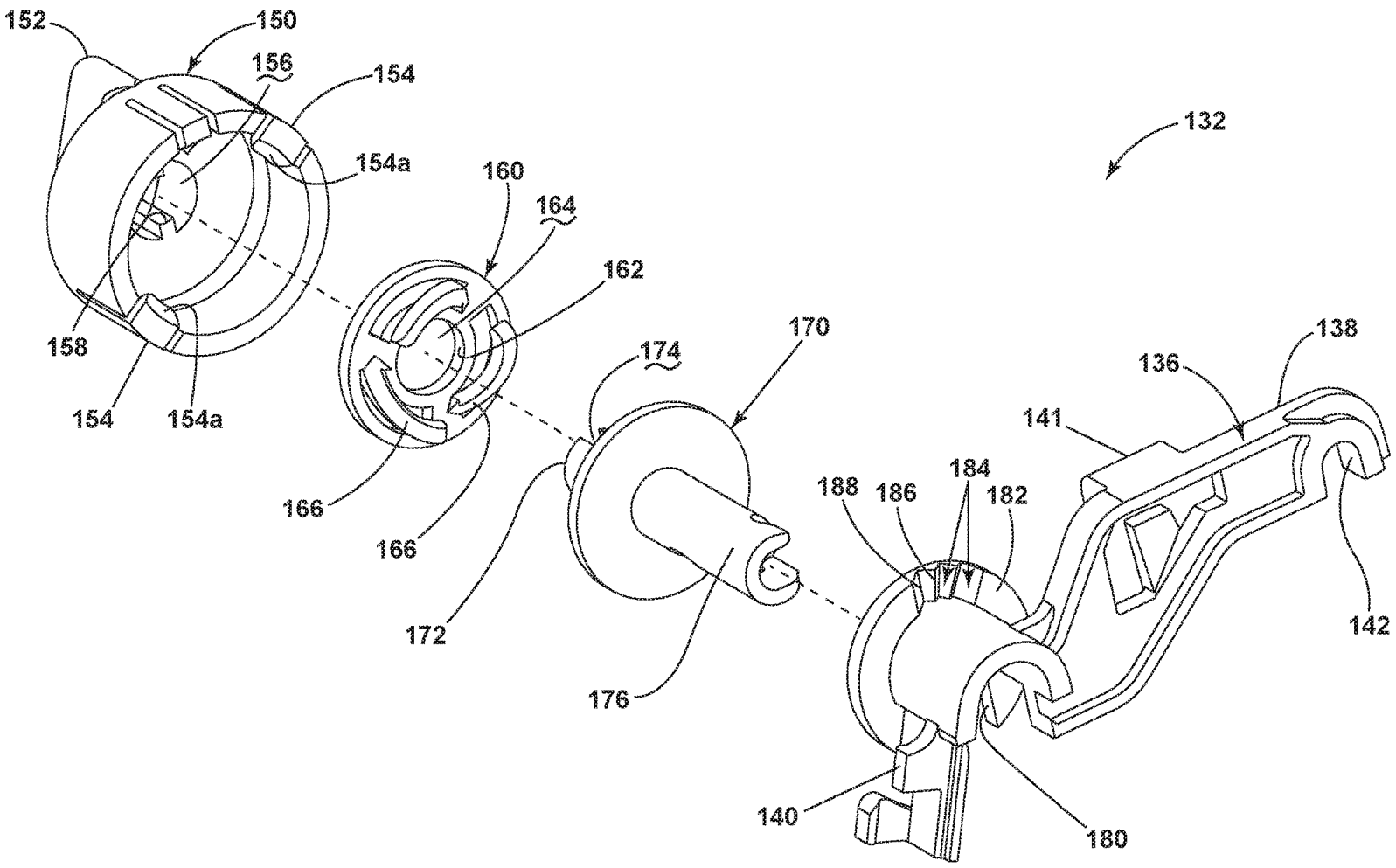
FIG. 8 illustrates a back perspective exploded view of the angle adjustment assembly of FIG. 4.

The clip 136 is shown in more detail including that a seat 180 and a plate 182 having a number of positional catches 184 is illustrated. The rotatable knob 150 is also illustrated in better detail including that it has at least one pawl or finger (FIG. 7) having a locking detent 154*a* at its end (FIG. 8). The number of positional catches 184 and/or the number of fingers with corresponding locking detents 154*a* provided on the knob 150 can determine the number of potential tine assembly 126 angles that can be provided by the tine angle adjustment assembly 132. While the tine angle adjustment assembly 132 is illustrated herein as having discrete positional catches 184 to determine the rotational position of the tine assembly 126, it will also be understood that other mechanisms can be provided. By way of non-limiting example, an attachment mechanism could be provided that allows for continuous rotational adjustment of the rotatable knob 150 relative to the upper dish rack 32 so that a larger variety of tine assembly 126 angles can be achieved.

Further still, a through passage 156 is illustrated as being defined through the body forming the rotatable knob 150. At least one key 158 extends into the through passage 156. The rotatable knob 150 is also illustrated as extending from the face 151 towards a rear periphery of the body to define a hollow interior. The fingers 154 with locking detents 154*a* are spaced about a rear periphery of the rotatable knob 150. While the rotatable knob 150 is illustrated herein as being provided with two locking detents 154*a* it will be understood that any suitable number of locking detents can be provided.

A bushing 170 is illustrated as being included in the tine angle adjust assembly 132 and includes a body having a plate and a first shaft 172 extending in a first direction and a second shaft 176 extending in a second direction opposite that of the first direction. A central passage 178 (FIG. 8) passes through the body of the bushing 170 and receives the extension 134 of the tine assembly 126. At least one slot 174 is located within the first shaft 172 and aligns with the at least one key of the rotatable knob 150 such that the at least one slot 174 receives the at least one key.

A biasing element 160 is located between the rotatable knob 150 and the bushing 170. The biasing element is illustrated as having an interior diameter or central opening 162 defining a passage 164. A set of spring fingers 166 are illustrated as being included in the biasing element 160. As better seen in FIG. 8, such spring fingers 166 abut the bushing about the first shaft 172.

As shown in FIG. 8, the set of positional catches 184 include a set of notches 188 radially spaced about at least a portion of the plate 182. The set of notches 188 have been illustrated as including three notches that define three use positions, the vertical use position (FIG. 5), the 30 degree angle use position illustrated at 126*a* (FIG. 6) and the 15 degree angle use position illustrated at 126*b* (FIG. 6). The set of notches 188 are separated by a set of tips 186 that angle away from the notch 188. An over-center action can be provided based on the profile of the set of tips and set of notches such that the locking detent can be moved to a fully engaged position within one of the set of notches 188 such that the locking detent 154*s* can define a plurality of discrete rotational positions about the plate 182.

It will be understood that any suitable number of catches 184 can be provided to define any suitable number of rotational positions for the tine assembly 126. The catches 184 can be provided as an array of notches 188 spaced from one another, and can be arranged in, by way of non-limiting example, a line or an arc. At least one limiter (not shown) can be provided adjacent the catches to limit the rotational movement of the set of tines 128 even when the set of tines 128 is in the uppermost vertical use position.

Figure 9:
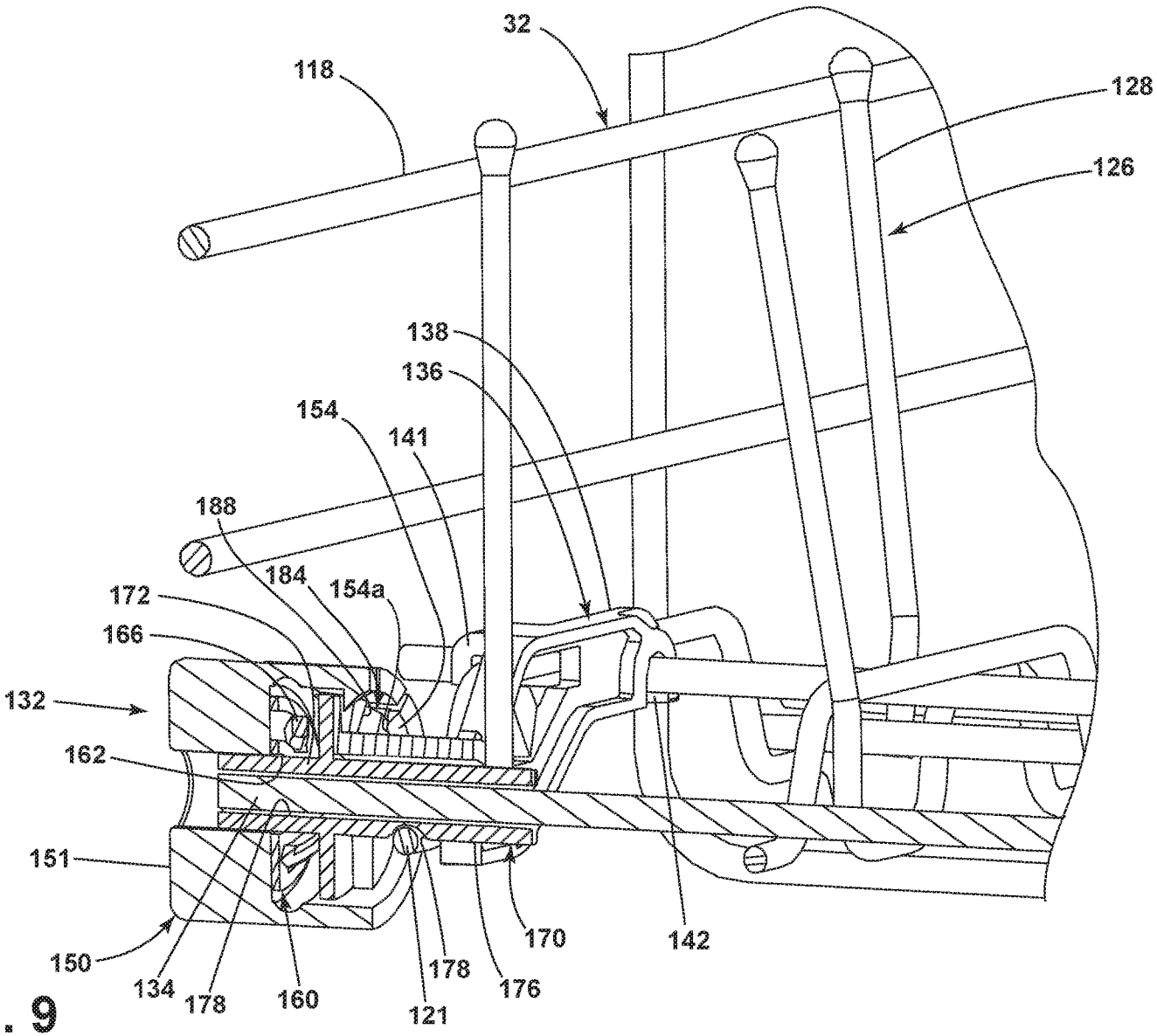
FIG. 9 illustrates a partially cutaway view portion of the upper dish rack with the adjustable tine row and angle adjustment assembly of FIG. 4 in the first position.

FIG. 9 illustrates the tine assembly 126 in the same position as illustrated in FIG. 5; more specifically, a vertical use position or first position. Further still, the biasing element 160 is illustrated in an expanded position, which provides a force on the rotatable knob 150, which acts to retain the rotatable knob 150 in an engaged position wherein the at least one detent 154*a* engages with at least one of the set of notches 188 to determine the rotational position of the set of tines 128 and lock the rotational position of the set of tines 128. An alignment feature 179 on the bushing 170 can be more easily seen in this view. The alignment feature can be a groove or other suitable contour within the bushing 170 that can mate or otherwise operably couple with a portion of the upper dish rack 32. Such feature not only helps aid in aligning the bushing 170 as well as the tine angle adjustment assembly 136 within the interior 122 but also adds some stability. It can also be better seen that the extension 134 of the cross member 130 is located within the bushing 170, which is in turn locked rotationally within the rotatable knob 150 by the key 158 (FIG. 8) being located within the slot 174. The rotational position of the extension 134 within the bushing 170 is also locked via a hook 173, which can interact with one of the set of tines 128 at the first distal end of tine assembly 126.

Figure 10:
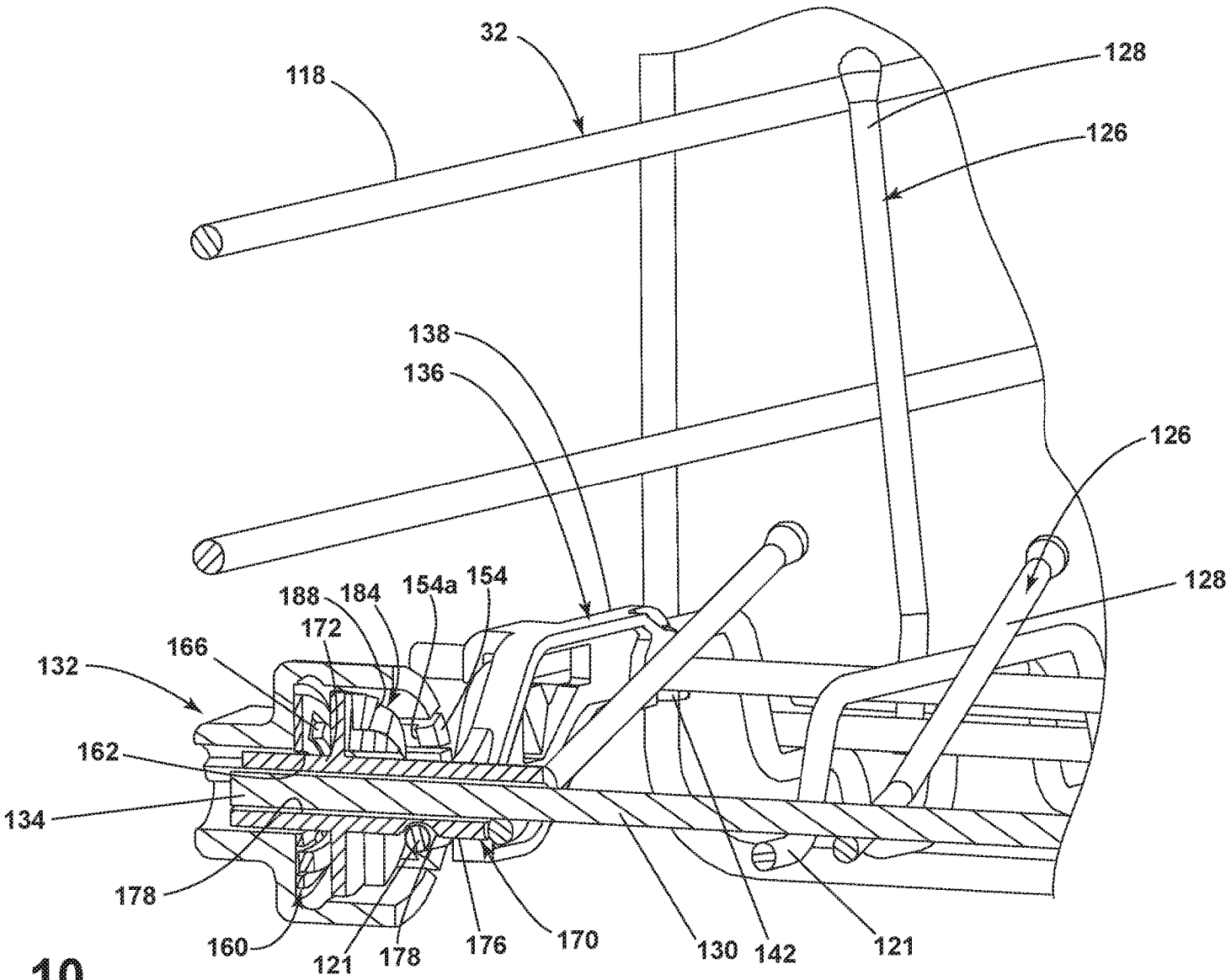
FIG. 10 illustrates a partially cutaway view portion of the upper dish rack with the adjustable tine row and angle adjustment assembly of FIG. 4 in the second position.

FIG. 10 illustrates the tine assembly 126 in the same position as illustrated in FIG. 6; more specifically, the stowed position or second position. Further still, the biasing element 160 is illustrated in a compressed position because force has been applied to the rotatable knob 150 by a user. More specifically, during operation of the tine assembly 126, a user can push in on the rotatable knob 150 and the springs 166 can compress such that the rotatable knob 150 can move towards a remainder of the tine angle adjustment assembly 132. As the biasing element 160 compresses the at least one key 158 of the rotatable knob 150 slides within the at least one slot 174 of the bushing 170 and the at least one locking detent 154*a* moves laterally away from the plate 182 and its corresponding set of catches 184. In this manner, the rotatable knob 150 disengages from the set of notches 188. Then, a user can turn the rotatable knob 150 and the set of tines 128 operably coupled thereto such that the rotational position of the set of tines 128 can be varied.

Once the push force from the rotatable knob 150 is removed by the user, the biasing element 160 is allowed to expand and the rotatable knob 150 is moved away from a remainder of the tine angle adjustment assembly 132. This action brings the locking detent 154*a* of the rotatable knob 150 to move to back into the engaged position with the set of catches 184 and lock the rotational position of the set of tines 128.

The aspects of the present disclosure described herein can be used to provide an adjustment assembly for the angular or rotational position of tines or a row of tines to allow selective repositioning of the tines between at least a first and second rotational position in a user-friendly and simple manner, while maintaining stability of the tines. The adjustment assembly ensures that the tines do not need to be bent to be repositioned, reducing likelihood of stressing the tines and also reducing the force needed to reposition the tines. The tines are also held firmly in position without the opportunity for the tines being left loose and unable to support dish items due to instability. The aspects of the present disclosure described herein also require few additional parts and are low cost and easy for a user to understand and manipulate including that the adjustable tine row allows for one handed adjustability by a user.

It will also be understood that various changes and/or modifications can be made without departing from the spirit of the present disclosure. By way of non-limiting example, although the present disclosure is described for use with a wire dish rack, it will be recognized that the tine angle adjustment assembly can be employed with various rack constructions, including molded racks, such as racks molded of plastic.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dish rack assembly, comprising:

at least one dish rack defining an interior;

at least one set of tines having at least a portion of the at least one set of tines extend into the interior of the dish rack, the at least one set of tines configured to rotate and having a protrusion extending along an axis of rotation of the at least one set of tines; and a tine angle adjustment assembly, comprising:

a clip having a body configured to mount on at least a portion of the at least one dish rack, the clip having a set of notches radially spaced about at least a portion of the body; and a rotatable knob having at least one detent and including a front face having a pointer indicating a rotational position of the set of tines, the rotatable knob operably coupled to the set of tines and wherein a position of the knob selectively rotationally locates the at least one detent with respect to the set of notches to determine a rotational position of the set of tines.

2. The dish rack assembly of claim 1 wherein the at least one set of tines includes a row of spaced tines coupled to a cross member.

3. The dish rack assembly of claim 2 wherein the row of spaced tines extends along one of a length or a width of the at least one dish rack.

4. The dish rack assembly of claim 3 wherein the protrusion extends from a first distal end of the cross member.

5. The dish rack assembly of claim 4, further comprising a fastener configured to mount to the dish rack and rotationally retain the cross member within a portion of the fastener.

6. The dish rack assembly of claim 5 wherein the fastener is located at a second distal end or centralized portion of the cross member.

7. The dish rack assembly of claim 1 wherein the set of notches includes a set of three notches defining three use positions.

8. The dish rack assembly of claim 7 wherein at least two of the use positions include different acute angles of the set of tines.

9. The dish rack assembly of claim 1 wherein the set of notches include at least one notch configured to provide an over-center action.

10. The dish rack assembly of claim 9 wherein movement of the knob rotates the set of tines to a different rotational position altering an angle between the set of tines and a bottom wall of the dish rack.

11. The dish rack assembly of claim 1 wherein the dish rack comprises a wire frame defining a floor and a perimeter wall extending from the floor and the clip includes at least one of a hook or a clip to fasten the clip to the wire frame.

12. A dish rack assembly, comprising:

at least one dish rack defining an interior;

at least one set of tines having at least a portion of the at least one set of tines extend into the interior of the dish rack, the at least one set of tines configured to rotate and having a protrusion extending along an axis of rotation of the at least one set of tines; and a tine angle adjustment assembly, comprising:

a clip having a body configured to mount on at least a portion of the at least one dish rack, the clip having a set of notches radially spaced about at least a portion of the body; and a rotatable knob having at least one detent and defining a through passage having at least one key, the rotatable knob operably coupled to the set of tines and wherein a position of the knob selectively rotationally locates the at least one detent with respect to the set of notches to determine a rotational position of the set of tines.

13. The dish rack assembly of claim 12, further comprising a bushing having a central passage configured to receive the protrusion and having at least one slot configured to receive the at least one key.

14. The dish rack assembly of claim 13, further comprising a biasing element located between the knob and the bushing and wherein the biasing element is compressible as the at least one key slides within the at least one slot.

15. The dish rack assembly of claim 14 wherein when the at least one key slides within the at least one slot, the at least one detent is configured to disengage from the set of notches and the rotational position of the set of tines can be varied.

16. The dish rack assembly of claim 15 wherein when the biasing element is in an expanded position the at least one detent engages with at least one of the set of notches to determine the rotational position of the set of tines and lock the rotational position.

17. The dish rack assembly of claim 12 wherein the set of notches includes a set of three notches defining three use positions.

18. The dish rack assembly of claim 17 wherein at least two of the use positions include different acute angles of the set of tines.

19. The dish rack assembly of claim 12 wherein the set of notches include at least one notch configured to provide an over-center action.

20. The dish rack assembly of claim 19 wherein movement of the knob rotates the set of tines to a different rotational position altering an angle between the set of tines and a bottom wall of the dish rack.

21. The dish rack assembly of claim 12 wherein the dish rack comprises a wire frame defining a floor and a perimeter wall extending from the floor and the clip includes at least one of a hook or a clip to fasten the clip to the wire frame.

22. The dish rack assembly of claim 12 wherein the at least one set of tines includes a row of spaced tines coupled to a cross member.

23. The dish rack assembly of claim 22 wherein the row of spaced tines extends along one of a length or a width of the at least one dish rack.

24. The dish rack assembly of claim 23 wherein the protrusion extends from a first distal end of the cross member.

25. The dish rack assembly of claim 24, further comprising a fastener configured to mount to the dish rack and rotationally retain the cross member within a portion of the fastener.

26. The dish rack assembly of claim 25 wherein the fastener is located at a second distal end or centralized portion of the cross member.

27. A dish rack assembly, comprising:

at least one dish rack defining an interior;

at least one set of tines having at least a portion of the at least one set of tines extend into the interior of the dish rack, the at least one set of tines configured to rotate and having a protrusion extending along an axis of rotation of the at least one set of tines; and a tine angle adjustment assembly, comprising:

a clip having a body configured to mount on at least a portion of the at least one dish rack, the clip having a set of notches radially spaced about at least a portion of the body;

a rotatable knob having at least one detent, the rotatable knob operably coupled to the set of tines and wherein a position of the knob selectively rotationally locates the at least one detent with respect to the set of notches to determine a rotational position of the set of tines;

a bushing having a central passage configured to receive the protrusion; and a biasing element located between the rotatable knob and the bushing and wherein the biasing element is compressible such that the at least one detent can be moved laterally away from the set of notches to disengage from the set of notches and the rotational position of the set of tines can be varied.

* * * * *